US009583898B2

(12) United States Patent
DeCola

(10) Patent No.: US 9,583,898 B2
(45) Date of Patent: Feb. 28, 2017

(54) MULTIPLE CONTACT JACK

(71) Applicant: GIBSON BRANDS, INC., Nashville, TN (US)

(72) Inventor: Jim DeCola, Thompsons Station, TN (US)

(73) Assignee: Gibson Brands, Inc., Nashville, TN (US)

( * ) Notice: Subject to any disclaimer, the term of this patent is extended or adjusted under 35 U.S.C. 154(b) by 0 days.

(21) Appl. No.: 14/586,937

(22) Filed: Dec. 30, 2014

(65) Prior Publication Data

US 2016/0190753 A1 Jun. 30, 2016

(51) Int. Cl.
*H01R 24/58* (2011.01)
*H01R 13/187* (2006.01)
*H01R 107/00* (2006.01)

(52) U.S. Cl.
CPC ..... *H01R 24/58* (2013.01); *H01R 13/187* (2013.01); *H01R 2107/00* (2013.01)

(58) Field of Classification Search
CPC ... H01R 24/58; H01R 2107/00; H01R 13/187
USPC ..... 439/668
See application file for complete search history.

(56) References Cited

U.S. PATENT DOCUMENTS 6,062,885 A 5/2000 White
6,350,150 B2 * 2/2002 DeLadurantaye, III ..... 439/502
7,618,294 B1 * 11/2009 Lin ..... H01R 13/701 200/51 R
7,967,643 B1 * 6/2011 D'Addario ..... H01R 24/58 439/669
7,988,498 B1 8/2011 Lim et al.
2002/0037669 A1 * 3/2002 D'Addario ..... H01R 13/17 439/669
2005/0037634 A1 * 2/2005 Khemakhem ..... H01R 24/52 439/63
2006/0105601 A1 5/2006 Tsai
2009/0011628 A1 * 1/2009 Purchon ..... H01R 13/7031 439/188
2011/0230087 A1 * 9/2011 Stantchev ..... H01R 13/6395 439/574
2011/0237110 A1 * 9/2011 Montena ..... H01R 9/0524 439/349
2012/0094521 A1 4/2012 Montena
2014/0038467 A1 2/2014 HON HAI PRECISION INDUSTRY CO., LTD.

OTHER PUBLICATIONS

International Search Report and Written Opinion of the International Searching Authority; Apr. 18, 2016; p. 1-11; Korean Intellectual Property Office, Daejeon Metropolitan City, Republic of Korea.

* cited by examiner

*Primary Examiner* — Abdullah Riyami
*Assistant Examiner* — Nelson R Burgos-Guntin
(74) *Attorney, Agent, or Firm* — Bates & Bates, LLC; Jim Patterson; Kathryn Cox

(57) ABSTRACT

A female jack is provided that includes one or more terminals and a reception aperture configured to accept a male plug. The female jack also includes a first spring contact with a first mating curvature configured to contact the male plug and create electrical contact between the male plug and the female jack. The first spring contact also includes one or more flex joints.

20 Claims, 4 Drawing Sheets

MULTIPLE CONTACT JACK

BACKGROUND

Male plugs are used along with female jacks in a wide variety of applications in which information, such as audio information, is transmitted from one device to another. A male plug at the end of a conductive cable is typically accepted and secured in a female jack by one or more curved spring members which also act as electrical contacts. In applications where the plugs, female jacks and/or the electrical cords and equipment with which they are associated are moved during operation, a plug may be jostled away from the curved spring members of a female jack in which it is secured, resulting in a loss of signal transmitted between the male plug and the female jack.

SUMMARY

In an example embodiment, a female jack includes one or more terminals and a reception aperture configured to accept a male plug. The female jack also includes a first spring contact with a first mating curvature configured to contact the male plug and create electrical contact between the male plug and the female jack. The first spring contact also includes one or more flex joints.

In another example embodiment, a piece of audio equipment includes a female jack. The female jack includes one or more terminals and a reception aperture configured to accept a male plug. The female jack also includes a first spring contact with a first mating curvature configured to contact the male plug and create electrical contact between the male plug and the female jack. The first spring contact further includes two or more contacting lengths.

In yet another example embodiment, a female jack is provided. The female jack includes a reception aperture configured to accept a male plug and two or more terminals. The female jack also includes a first spring contact having a first mating curvature configured to secure the male plug to the female jack and create electrical contact between the male plug and the female jack. The first spring contact also has one or more flex joints. The female jack further includes a second spring contact with a second mating curvature configured to contact the male plug creating electrical contact between the male plug and the female jack. The second spring contact also has one or more flex joints.

This summary is not intended to identify key or essential features of the claimed subject matter, nor is it intended to be used as an aid in limiting the scope of the claimed subject matter.

Other principal features of the current disclosure will become apparent to those skilled in the art upon review of the following drawings, the detailed description, and the appended claims.

BRIEF DESCRIPTION OF THE DRAWINGS

Illustrative embodiments will be described referring to the accompanying drawings, wherein like numerals denote like elements.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

As described herein, various techniques and technologies can be associated with using one or more flex slots in a mating curvature of a spring contact to create two or more contacting lengths capable of moving relative to one another as they come into contact with a male plug inserted into a female jack. Allowing movement of the contacting lengths in this manner can result in both an increased number of contacts, and an increased area of surface contact, between the spring contact in the female jack and the male plug inserted therein.

Example Female Jacks

Figure 1:
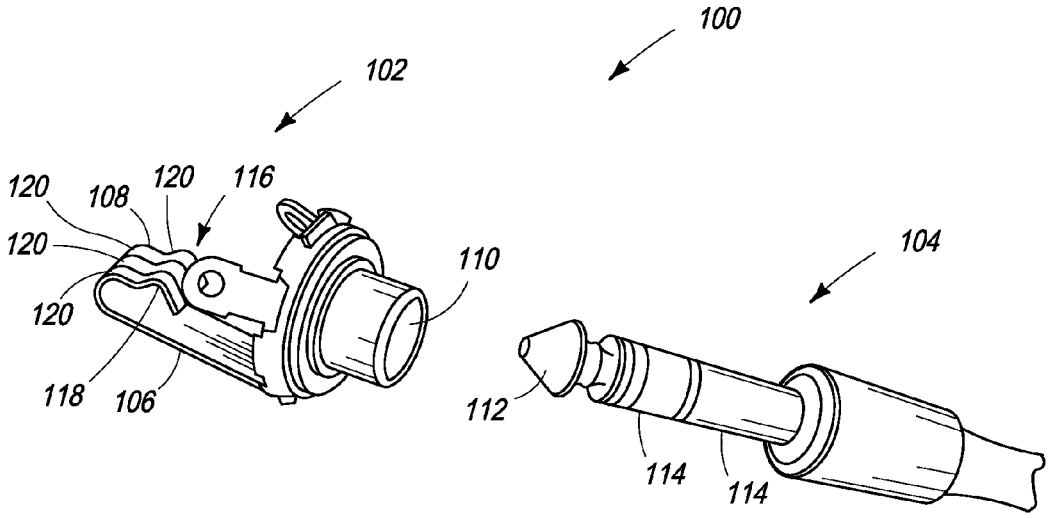
FIG. 1 depicts a female jack and a corresponding male plug in accordance with an illustrative implementation.

FIG. 1 illustrates a system 100 including a female jack 102 and a corresponding male plug 104, in accordance with one possible implementation. Female jack 102 can include any type of jack known in the art, including, for example, a jack configured to be used with audio equipment (including musical equipment (such as guitars, keyboards, music amplifiers, speakers, musical effect devices, etc.), headphones, amplifiers, microphones, computing devices, communication devices, and so on). In FIG. 1, female jack 102 is depicted as a mono jack, with one spring contact 106 configured to communicate with plug 104. It will be understood, however, that jack 102 is not limited to any single configuration. Rather, jack 102 can be configured to communicate any number of electric signals between itself and plug 104. Thus jack 102 can be a stereo jack, a jack communicating three or more signals to and/or from plug 104, etc. Moreover, jack 102 can come in any size known in the art, including a 0.25 inch female jack.

Similarly, male plug 104 can include any type of plug known in the art, including, for example, a plug to convey information, such as audio information, to and/or from audio equipment. Male plug 104 can come in any size known in the art.

Spring contact 106 can be made of any conductive material known in the art, including, for example, copper, steel, etc. Spring contact 106 can also be made of a material and/or constructed in such a way as to have elasticity such that it can elastically bend or spring when placed in contact with plug 104.

Spring contact 106 can also include a mating curvature 108 configured to receive and contact plug 104 when plug 104 is inserted into a reception aperture 110 of jack 102. In this way, once mated plug 104 is mated to jack 102, an electric signal can be passed from plug 104 to mating curvature 108 (and thus jack 102). In one implementation, the electric signal is passed from a tip 112 of plug 104 contacting mating curvature 108. In another possible implementation, the electric signal may be passed from one or more rings 114 (if present) on plug 104 contacting mating curvature 108.

Mating curvature 108 can be configured in any fashion known in the art. For example, in one possible implementation, mating curvature 108 can include a simple curve to contact plug 104—such as at tip 112, ring 114, etc.—in order to communicate an electric signal between jack 102 and plug 104. Alternately, in another possible implementation (as shown in FIG. 1), mating curvature 108 can include a securing geometry 116 including a ridge 118 and basin 120 configured to contact and secure tip 112 of plug 104 when plug 104 is inserted in jack 102. In yet another possible implementation, mating curvature 108 can be placed on spring contact 106 to a contact ring 114, if present, on plug 104.

Spring contact 106 can also include a plurality of contacting lengths 120 configured to move relative to one another.

Figure 2:
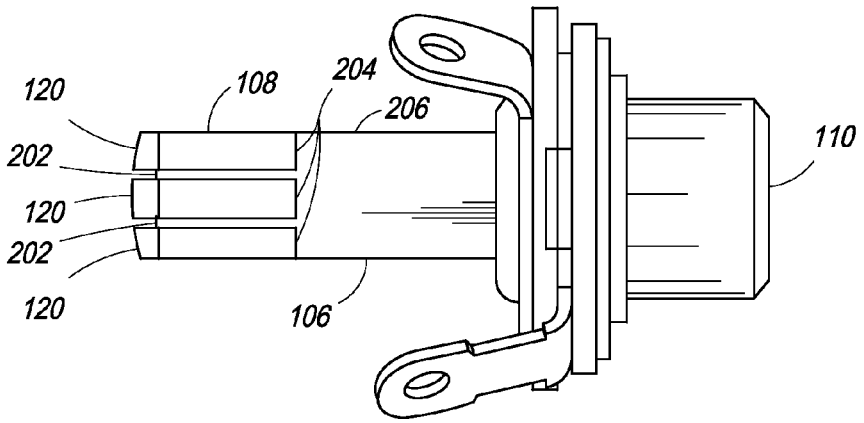
FIG. 2 depicts a plurality of contacting lengths on a female jack in accordance with another illustrative implementation.

FIG. 2 depicts contacting lengths 120 on spring contact 106 in greater detail. Spring contact 106 can have two or more contacting lengths 120 separated from one another by flex joints 202. In one possible implementation, flex joints 202 can comprise slots extending through an entire thickness of spring contact 106. In such an implementation, contacting lengths 120 can move relative to one another in any of several directions. In another possible implementation, flex joints 202 can comprise scores, such as grooves, extending through a portion of the thickness of spring contact 106, forming hinges between contacting lengths 120. In yet another possible implementation, flex joints 202 can comprise a combination of the above described slots and scores.

Flex joints 202 can run along any length of spring contact 106. For example, flex joints 202 can run from a terminal end 204 of spring contact 106 through any length of mating curvature 108. In another possible implementation, flex joints 202 can run from terminal end 204 through mating curvature 108 into some or all of a body 206 of spring contact 106. Additionally, in another possible implementation, flex joints 202 can start in mating curvature 108 (i.e. not at terminal end 204) and extend any length into mating curvature 108 and/or body 206 of spring contact 106. Additionally, individual flex joints 202 on spring contact 106 can have different lengths, including having different starting and ending points on spring contact 106.

Figure 3:
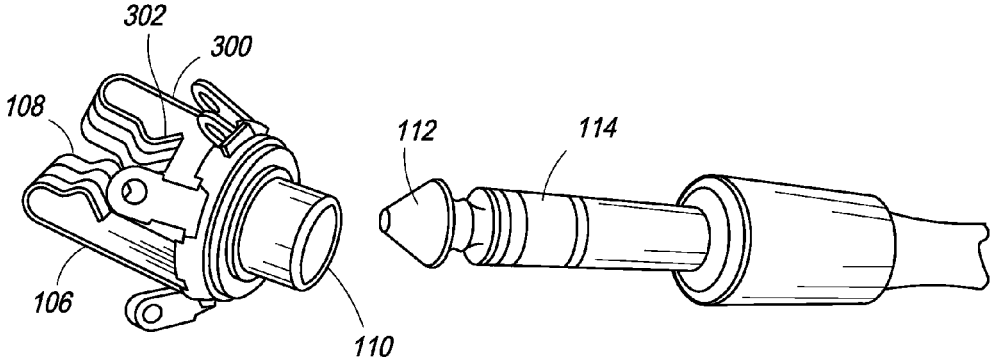
FIG. 3 depicts a female jack and a corresponding male plug in accordance with another illustrative implementation.

FIG. 3 depicts female jack 102 in an alternate stereo configuration. As illustrated, jack 102 includes a second spring contact 300 comprising a second mating curvature 302, which can be configured in any fashion known in the art, including all of the possible configurations described above in conjunction with mating curvature 108. In the stereo configuration illustrated in FIG. 3, jack 102 is able to receive two signals from plug 104, including two separate signals. For example, when plug 104 is mated to jack 102, a first signal from jack plug 104 can be received from tip 112 of plug 104 by mating curvature 108 of spring contact 106. A second signal from jack plug 104 can be received from ring 114 of plug 104 by second mating curvature 302 of second spring contact 300.

It will be understood that signals between jack 102 and plug 104 can travel in any possible directions. For example, in one possible implementation, electric signals can travel from plug 104 to jack 102. In another possible implementation, electric signals can travel from jack 102 to plug 104. In another possible implementation, electric signals can be communicated between jack 102 and plug 104 in any possible direction.

Figure 4:
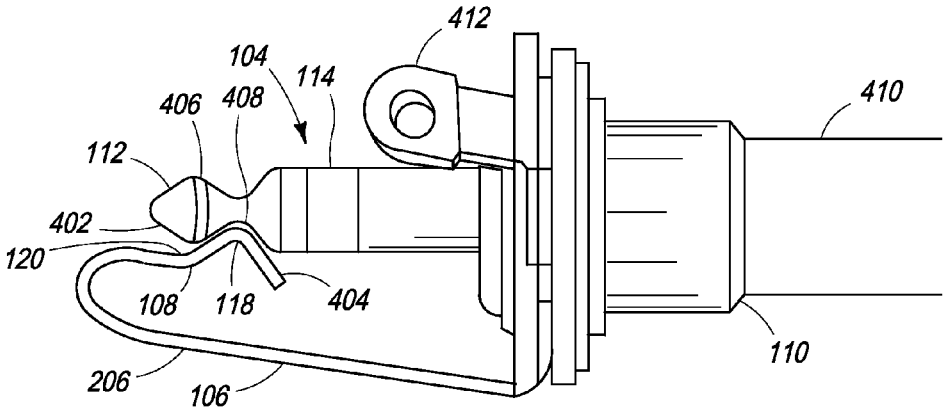
FIG. 4 depicts a male plug secured in a female jack in accordance with an illustrative implementation.

FIG. 4 depicts a male plug 104 secured in female jack 102 in accordance with one possible implementation. In operation, when plug 104 is inserted into reception aperture 110 of jack 102, a sloped forefront 402 of tip 112 encounters a first sloped surface 404 of mating curvature 108 on spring contact 106. As plug 104 moves further into jack 102, a protrusion 406 of tip 110 encounters and then clears ridge 118 on mating curvature 108. Protrusion 406 can then settle into basin 120 of mating curvature 108.

In one implementation, spring contact 106 is at least somewhat elastic, such that ridge 118 compresses toward body 206 when tip 112 contacts spring member 106. In such a manner, when ridge 118 contacts a depression 408 of plug 104, mating curvature 108 (including ridge 118) exerts a contact force against plug 104. The contact force can establish electrical communication between plug 104 and spring member 106. The contact force can also help to secure plug 104 to mating curvature 108 of spring contact 106 by resisting movement of tip 112 toward reception aperture 110. In one possible embodiment, a body 410 of plug 104 has a diameter exceeding the diameter of reception aperture 110, thus limiting how far tip 112 can be inserted into jack 102.

As illustrated in FIG. 4, the placement of body 410 on plug 104 can allow tip 112 to be inserted into jack 102 far enough to mate with mating curvature 108 of spring contact 106. In another possible embodiment, body 410 can be placed farther away from tip 112 on plug 104, such that tip 112 can be inserted farther into jack 102. In such a case body 410 can be placed to allow tip 112 to travel far enough into jack 102 such that ridge 118 makes electrical contact with ring 114. Such a configuration may be used by second mating curvature 302 on second spring contact 300 (as shown in FIG. 3) to make electrical contact with ring 114 on plug 102 while mating curvature 108 on spring contact 106 simultaneously makes electrical contact with tip 112, allowing communication of two separate signals between jack 102 and plug 104

Depending on the number of signals being communicated between jack 102 and plug 104, any number of terminals 412 can be included on jack 102, in any configuration known in the art. For instance, in one possible implementation, if one signal is being communicated between jack 102 and plug 104, one terminal 412 can be connected to spring member 106 and another terminal can be configured to be connected to ground. In another possible implementation, if two signals are being communicated between jack 102 and plug 104, one terminal 412 can be connected to spring member 106, another terminal 412 can be connected to second spring member 300, and still another terminal 412 can be configured to be connected to ground.

Figure 5:
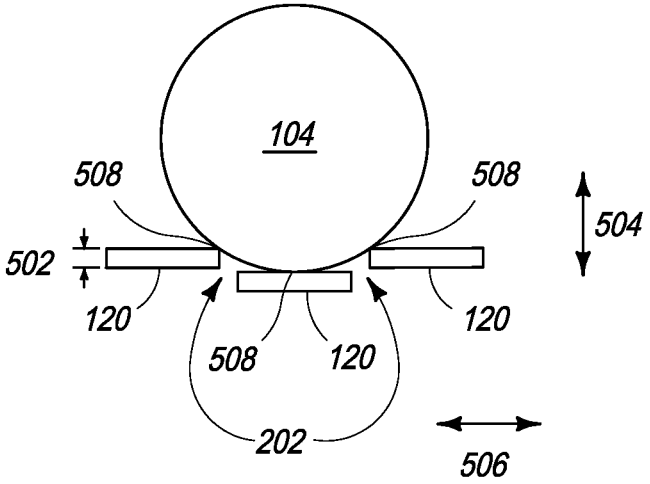
FIG. 5 depicts a plurality of contacting lengths contacting a male plug in accordance with an illustrative embodiment.
Figure 6:
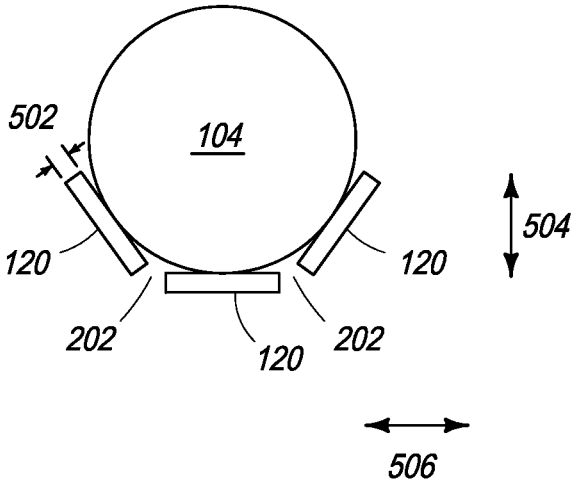
FIG. 6 depicts a plurality of contacting lengths contacting a male plug in accordance with another illustrative embodiment.

FIGS. 5-6 depict a plurality of contacting lengths 120 contacting male plug 104 in accordance with several illustrative embodiments. As illustrated, contacting lengths 120 are separated by flex joints 202 running through an entire thickness 502 of spring member 106. Flex joints 202 can have any desirable width, and can enable contacting lengths 120 to move with respect to each other in several directions, including along axes 504, 506 and any combination thereof.

When contacting lengths 120 come into contact with plug 104 (such as when contacting lengths 120 come into contact with tip 112 and/or rings 114 of plug 104 as described in the various embodiments above), contacting lengths 120 are free to move separately in order to contact several areas 508 of plug 104. This stands in contrast to a scenario in which only one contacting length is used. In such a scenario only one contact area would exist.

In one possible implementation, use of multiple contacting lengths 102 can increase a number of electric contacts between spring contact 106 and plug 104 and/or a total area of contact between spring contact 106 and plug 104. Moreover, because of the independence of movement of contacting lengths 120, if plug 104 moves relative to jack 102 (such as for example, due to movement of jack 102, plug 104, or equipment with which jack 102 and/or plug 104 are associated) there is an increased chance that at least one of the contacting lengths 120 will maintain electrical contact with plug 104 during the movement, thus preventing a loss of signal between jack 102 and plug 104.

FIG. 5 illustrates a behavior of rigid contacting lengths 120 in which movement occurs in direction 504, but little or no movement occurs in direction 506. Rigid contacting lengths can result, for example, when a rigid material is used to create spring contact 106, when flex joints 202 have a short length along spring contact 106, etc. In such a scenario, contacting lengths 120 can establish contact areas 508 as shown.

FIG. 6 illustrates a behavior of less rigid contacting lengths 120 in which movement occurs in both directions 504 and 506. Less rigid contacting lengths 120 can result, for example, when a less rigid material is used to create spring contact 106, when flex joints 202 have a greater length along spring contact 106, etc. In such a scenario, contacting lengths 120 can move and rotate relative to one another to establish contact areas 508 as shown.

It will be understood that a combination of behaviors shown in FIGS. 5 and 6 can result, such as when contacting lengths 120 are of medium rigidity and/or have flex joints 202 of medium length along spring contact 106. Moreover, as noted above, lengths and widths of flex joints 202 can vary, such that some contacting lengths can be less rigid than others. Thus any combination of the behaviors of contacting lengths 120 shown in FIGS. 5 and 6 can be seen across the various contacting lengths 120.

Figure 7:
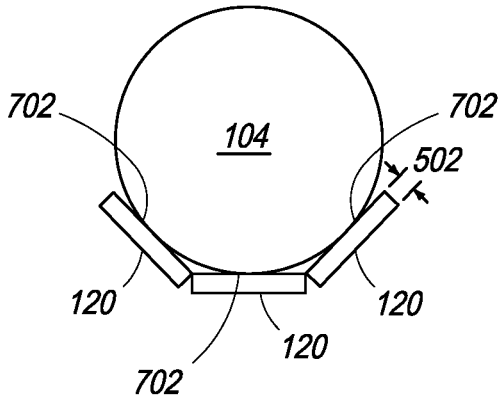
FIG. 7 depicts a plurality of contacting lengths contacting a male plug in accordance with yet another illustrative embodiment.

FIG. 7 depicts a plurality of contacting lengths 120 contacting male plug 104 in accordance with another illustrative embodiments. As illustrated, contacting lengths 120 are separated by flex joints 202 comprising scores running through a portion of thickness 502 of spring member 106. Flex joints 202 thus enable contacting lengths 120 to move with respect to each other by pivoting relative to one another.

Thus, when contacting lengths 120 come into contact with plug 104 (such as when contacting lengths 120 come into contact with tip 112 and/or rings 114 of plug 104 as described in the potential embodiments above), contacting lengths 120 are free to pivot in order to contact several areas 702 of plug 104.

As noted above, any combination of flex joints 202 can be used in conjunction with contacting lengths 120. Thus one or more flex joints 202 may comprise scores running through a portion of thickness 502 of spring member 106, while one or more other flex joints 202 may comprise flex slots running through an entire thickness 502 of spring member 106

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" is intended to include "and/or" unless specifically indicated otherwise. The illustrative embodiments may be implemented as a method, apparatus, or article of manufacture using standard engineering techniques.

Illustrative Embodiments

The following embodiments are illustrative and are not intended to limit the scope of the disclosed subject matter.

Embodiment 1

A female jack comprising:
a reception aperture configured to accept a male plug;
one or more terminals; and
a first spring contact including:
a first mating curvature configured to contact the male plug and create electrical contact between the male plug and the female jack; and
one or more flex joints.

Embodiment 2

The female jack of claim 1, wherein the female jack is a 0.25 inch female jack.

Embodiment 3

The female jack of claim 1, wherein the one or more flex joints comprise scores through a portion of a thickness of the first spring contact.

Embodiment 4

The female jack of claim 1, wherein the mating curvature includes a securing geometry to secure the male plug in the female jack.

Embodiment 5

The female jack of claim 1, wherein the one or more flex joints comprise slots through an entire thickness of the first spring contact.

Embodiment 6

The female jack of claim 1, wherein the one or more flex joints run through at least a portion of a length of the first mating curvature.

Embodiment 7

The female jack of claim 1, wherein the one or more flex joints comprise two flex joints in the first spring contact.

Embodiment 8

The female jack of claim 1, wherein the female jack is configured to be used with musical equipment.

Embodiment 9

The female jack of claim 1, further including:
a second spring contact including:
a second mating curvature configured to contact the male plug; and
one or more flex joints.

Embodiment 10

The female jack of claim 9, wherein the second spring contact is configured to contact the male plug at a position different than that contacted by the first spring contact when the male plug is secured in the female jack.

Embodiment 11

The female jack of claim 9, wherein the female jack is configured to be used with musical equipment.

Embodiment 12

A piece of audio equipment comprising:
a female jack including:
a reception aperture configured to accept a male plug;
one or more terminals; and
a first spring contact including:
a first mating curvature configured to contact the male plug and create electrical contact between the male plug and the female jack, and
two or more contacting lengths.

Embodiment 13

The piece of audio equipment of claim 12, wherein the piece of audio equipment comprises a music amplifier.

Embodiment 14

The piece of audio equipment of claim 12, wherein the first mating curvature includes a securing geometry to secure the male plug in the female jack.

Embodiment 15

The piece of audio equipment of claim 12, wherein the two or more contacting lengths are defined by one or more flex joints through an entire thickness of the spring contact.

Embodiment 16

The piece of audio equipment of claim 12, further including:
a second spring contact including:
a second mating curvature configured to contact the male plug creating electrical contact between the male plug and the female jack, wherein the second mating curvature includes two or more contacting lengths.

Embodiment 17

A female jack comprising:
a reception aperture configured to accept a male plug;
two or more terminals;
a first spring contact including:
a first mating curvature configured to secure the male plug to the female jack and create electrical contact between the male plug and the female jack; and
one or more flex joints; and
a second spring contact including:
a second mating curvature configured to contact the male plug creating electrical contact between the male plug and the female jack; and
one or more flex joints.

Embodiment 18

The female jack of claim 17, wherein at least some of the one or more flex joints comprise slots through an entire thickness of the spring contacts.

Embodiment 19

The female jack of claim 17, wherein the one or more flex joints in the first spring contact run along a length of the first spring contact configured to contact a tip of the male plug when the male plug is secured in the female jack; and further wherein the one or more flex joints in the second spring contact run along a length of the second spring contact configured to contact a ring of the male plug when the male plug is secured in the female jack.

Embodiment 20

The female jack of claim 17, wherein at least some of the one or more flex joints comprise scores through a portion of a thickness of the first spring contact and a portion of a thickness of the second spring contact.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated. It is intended that the scope of the disclosed subject matter be defined by the claims appended hereto and their equivalents.

What is claimed is:

1. A female jack comprising:
a reception aperture configured to accept a male plug;
one or more terminals; and
a first spring contact including:
a first mating curvature configured to contact the male plug and create electrical contact between the male plug and the female jack; and
one or more flex joints running at least a portion of a length of the first spring contact, wherein the one or more flex joints comprise one or more scores through a portion of a thickness of the first spring contact defining two or more hinged contacting lengths extending the portion of the length of the first spring.

2. The female jack of claim 1, wherein the female jack is a 0.25 inch female jack.

3. The female jack of claim 1, wherein the one or more flex joints extend to a terminal end of the first spring contact.

4. The female jack of claim 1, wherein the mating curvature includes a securing geometry to secure the male plug in the female jack.

5. The female jack of claim 1, wherein the first spring contact comprises one or more of:
copper;
steel.

6. The female jack of claim 1, wherein the one or more flex joints run through at least a portion of a length of the first mating curvature.

7. The female jack of claim 1, wherein the one or more flex joints comprise two flex joints in the first spring contact.

8. The female jack of claim 1, wherein the female jack is configured to be used with musical equipment.

9. The female jack of claim 1, further including:

a second spring contact including:

a second mating curvature configured to contact the male plug; and one or more flex joints.

10. The female jack of claim 9, wherein the second spring contact is configured to contact the male plug at a position different than that contacted by the first spring contact when the male plug is secured in the female jack.

11. The female jack of claim 9, wherein the female jack is configured to be used with musical equipment.

12. A piece of audio equipment comprising:

a female jack including:

a reception aperture configured to accept a male plug;

one or more terminals; and a first spring contact including:

a first mating curvature configured to contact the male plug and create electrical contact between the male plug and the female jack; and one or more slots through an entire thickness of the first spring contact along a portion of a length of the first spring contact, forming two or more substantially adjacent and parallel contacting lengths along the portion of the length of the first spring contact.

13. The piece of audio equipment of claim 12, wherein the piece of audio equipment comprises a music amplifier.

14. The piece of audio equipment of claim 12, wherein the first mating curvature includes a securing geometry to secure the male plug in the female jack.

15. The piece of audio equipment of claim 12, wherein the one or more slots form the two or more adjacent and parallel contacting lengths by splitting the first spring contact into the two or more substantially adjacent and parallel contacting lengths along the portion of the length of the first spring contact.

16. The piece of audio equipment of claim 12, further including:

a second spring contact including:

a second mating curvature configured to contact the male plug creating electrical contact between the male plug and the female jack, wherein the second mating curvature includes two or more contacting lengths.

17. A female jack comprising:

a reception aperture configured to accept a male plug;

two or more terminals;

a first spring contact including:

a first mating curvature configured to secure the male plug to the female jack and create electrical contact between the male plug and the female jack; and one or more flex joints defining a first set of two or more substantially parallel contacting lengths; and a second spring contact including:

a second mating curvature configured to contact the male plug creating electrical contact between the male plug and the female jack; and one or more flex joints defining a second set of two or more substantially parallel contacting lengths.

18. The female jack of claim 17, wherein at least some of the one or more flex joints comprise slots through an entire thickness of the spring contacts.

19. The female jack of claim 17, wherein the one or more flex joints in the first spring contact run along a portion of a length of the first spring contact configured to contact a tip of the male plug when the male plug is secured in the female jack, and further wherein the one or more flex joints in the second spring contact run along a portion of a length of the second spring contact configured to contact a ring of the male plug when the male plug is secured in the female jack.

20. The female jack of claim 17, wherein at least some of the one or more flex joints comprise scores through a portion of a thickness of the first spring contact and a portion of a thickness of the second spring contact.

* * * * *